United States Patent [19]

Weinberger et al.

[11] Patent Number: 4,712,907

[45] Date of Patent: Dec. 15, 1987

[54] SEQUENCING MEANS FOR PHOTOCOPYING PROCESSES

[75] Inventors: Joseph Weinberger, Brunswick, N.J.; Gary S. Bricault, Rochester, N.Y.; David Gruber, Rochester, N.Y.; Eleonora Rakover, Rochester, N.Y.

[73] Assignee: Xerox Corporation, Stamford, Conn.

[21] Appl. No.: 794,129

[22] Filed: Nov. 1, 1985

[51] Int. Cl.[4] ..... G03G 15/00

[52] U.S. Cl. ..... 355/7; 355/14 R; 355/14 E; 355/41

[58] Field of Search ..... 355/7, 14 R, 14 E, 14 CH, 355/3 CH, 40, 41, 43, 133; 354/5

[56] References Cited

U.S. PATENT DOCUMENTS

| | | | |
|---|---|---|---|
| 3,029,717 | 4/1962 | Hildebrandt | 95/1.1 |
| 3,105,425 | 10/1963 | Cerasani et al. | 355/13 |
| 3,135,179 | 6/1964 | Cerasani et al. | 355/13 |
| 3,135,180 | 6/1964 | Cerasani et al. | 355/13 |
| 3,244,084 | 4/1966 | Davis | 355/13 |
| 3,348,522 | 10/1967 | Donohue | 355/14 D |
| 3,348,523 | 10/1967 | Davidson et al. | 355/14 D |
| 3,427,658 | 2/1969 | Roberts | 430/54 |
| 3,437,020 | 4/1969 | Wright et al. | 355/40 |
| 3,485,622 | 12/1969 | Sewell | 355/13 X |
| 3,526,456 | 9/1970 | Sage et al. | 355/4 |
| 3,612,684 | 10/1971 | Jones et al. | 355/40 |
| 3,734,612 | 5/1973 | Harvey et al. | 355/40 |
| 3,764,211 | 10/1973 | Morse et al. | 355/71 |
| 3,775,007 | 11/1973 | Davidson | 355/8 |
| 3,824,604 | 7/1974 | Stein | 354/5 |
| 3,827,802 | 8/1974 | Pfeifer et al. | 355/41 |
| 3,846,150 | 11/1974 | Forgo et al. | 430/54 |
| 3,980,476 | 9/1976 | Wysocki | 430/54 X |
| 4,029,414 | 6/1977 | Rubenstein | 355/112 |
| 4,093,370 | 6/1978 | Frech | 355/43 |
| 4,161,362 | 7/1979 | Blake | 355/3 R |
| 4,277,190 | 7/1981 | Rudy et al. | 355/40 X |
| 4,294,534 | 10/1981 | Snelling | 355/3 R |
| 4,303,332 | 12/1981 | Sakai | 355/14 R |
| 4,324,484 | 4/1982 | Johnson | 355/5 |
| 4,340,295 | 7/1982 | Nakamura | 355/7 X |
| 4,346,982 | 8/1982 | Nakajima et al. | 355/3 R |
| 4,352,554 | 10/1982 | Kaye et al. | 355/40 |
| 4,378,156 | 3/1983 | Yajima et al. | 355/7 X |
| 4,398,816 | 8/1983 | Nakajima et al. | 355/3 R |
| 4,419,010 | 12/1983 | Grombone et al. | 355/133 |
| 4,427,290 | 1/1984 | Kaye et al. | 355/40 |
| 4,435,064 | 3/1984 | Tsukada et al. | 355/1 |
| 4,447,148 | 5/1984 | Hatzis | 355/175 |
| 4,466,731 | 8/1984 | Champion et al. | 355/140 |
| 4,472,047 | 9/1984 | Stoudt | 355/4 |
| 4,472,050 | 9/1984 | Stockburger et al. | 355/40 |
| 4,490,032 | 12/1984 | Conly et al. | 355/14 R |
| 4,502,778 | 3/1985 | Dodge et al. | 355/14 E |
| 4,537,490 | 8/1985 | Stoudt | 430/54 |
| 4,544,259 | 10/1985 | Kanaoka et al. | 355/1 |
| 4,551,008 | 11/1985 | Banton | 355/14 E |
| 4,575,224 | 3/1986 | Arnold | 355/14 R |
| 4,582,417 | 4/1986 | Yagasaki et al. | 355/14 R X |

FOREIGN PATENT DOCUMENTS

| | | |
|---|---|---|
| 58-2829 | 1/1983 | Japan . |
| 59-87470 | 5/1984 | Japan . |

OTHER PUBLICATIONS

Xerox Disclosure Journal, vol. 1, No. 5, May 1976–Koehler.

IBM Technical Disclosure Bulletin, vol. 13, No. 12, May 1971–Harris.

Radionics, Inc., 1977 prior use—The Attached Copy of Photos Marked A–F Show the Prior Art Described on page 1, line 31 to page 2 line 4 of the Subject Specification.

*Primary Examiner*—A. C. Prescott

*Attorney, Agent, or Firm*—H. Fleischer; J. E. Beck; R. Libelli

[57] ABSTRACT

An electrophotographic printing machine for reproducing an original document with a copy thereof having additional indicia thereon. A means such as a movable occluder bar is used to mask a region of photoconductive member from the illuminating means to prevent discharge at that region. Then a means to discharge selectively the masked region reocrds a latent image corresponding to the additional indicia.

5 Claims, 30 Drawing Figures

INTERRUPT HANDLER
(Actual serial number and title projection)

To & From Fig. 13F-2

INTERRUPT HANDLER
(Actual serial number and title projection)

SEQUENCING MEANS FOR PHOTOCOPYING PROCESSES

FIELD OF THE INVENTION

The invention relates to a system and method for sequentially indexing copies of documents produced by photo reproduction machines.

BACKGROUND OF THE INVENTION

Rapid reproduction of documents by photocopying has been performed for many years, with continuous efforts directed to improving the speed of reproduction, the resolution of the replicas and the capacity of the photocopying machines.

Various processes exist for photocopying documents with a dominant process being the xerographic process. Basically, the xerographic process proceeds by: electrically charging the surface of a rotating belt or drum; selectively discharging a portion of the charged surface by reflecting a light pattern off an original document to be copied onto the charged surface to leave a charge pattern only in the form of the printed matter of the original document; adhering dye material (toner) to the charged portion of the surface; transferring the toner to a sheet of copy paper; and securing the toner to the copy paper.

Among the efforts to enhance the advantages of photocopying has been an attempt to provide a means to serially mark or paginate the documents reproduced in the photo reproduction process.

In about 1977, Radionics, Inc., Rochester, N.Y., developed a method and mechanism by which serial marking of reproduced documents could be achieved. The method employed an opaque tape on the photocopier document-receiving platen to prevent discharging of a local area of each document charge image produced on the charged surface and thereafter discharge of a portion of the local area by a light pattern in the form of one of a sequence of numbers stored in a light source.

SUMMARY OF THE INVENTION

It is an object of the present invention to provide a system and method for sequentially marking copies made from photocopying machines.

It is another object of the invention to provide a means for sequentially marking the copied documents with a vast permutation of numbers, and letters of alphanumeric systems.

It is a still further object of the present invention to provide a means for serially marking reproduced documents under controlled exposure conditions to afford enhanced resolution of the characters.

The recited objects and other advantages are provided by the system and method of the invention, which embodies a device within the photocopying machine that masks the image-forming light from discharging a portion of the electrostatically charged light sensitive surface on which the image patterns are formed and thereafter forms a character image pattern, either numerical, alphabetic or alphanumeric in the masked portion by either discharging the character area or the area surrounding and defining the character area. Finally, conventional toner is adhered to the character image pattern which is then transferred to the copy document with the original document image.

DESCRIPTION OF THE DRAWINGS

The invention will be more clearly understood when viewed in association with the following drawings in which.

DESCRIPTION OF THE PREFERRED EMBODIMENT

The present invention will be described in the environment of a xerographic photocopy machine 2, however broader application to photocopying generally applies.

Figure 1:
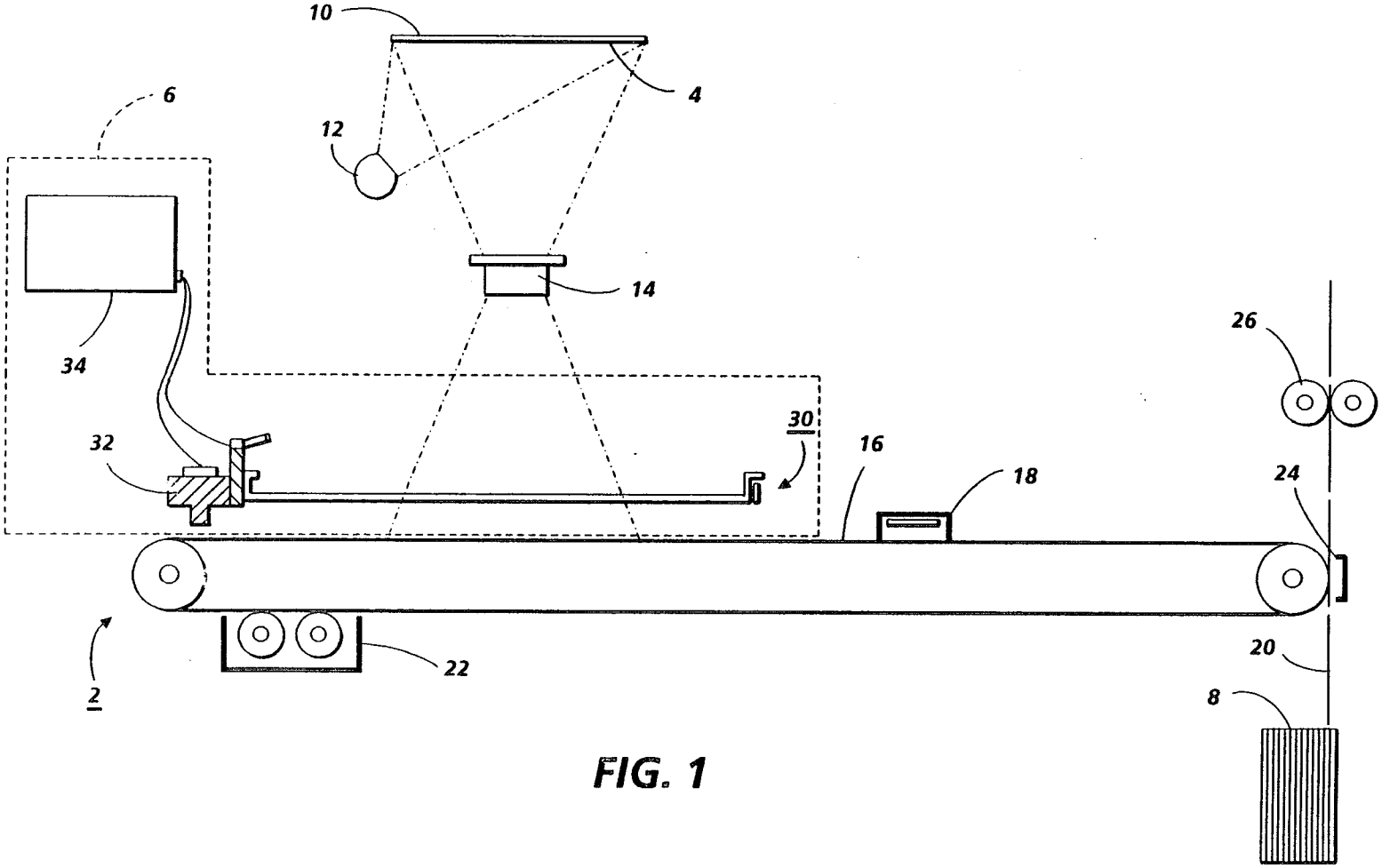
FIG. 1 is a diagrammatic view in elevation of the sequencing device of the present invention arranged in a conventional xerographic photocopy machine.

As seen in FIG. 1, the xerographic photocopy machine 2 is shown embodying the essential elements of a conventional photocopy machine and the serializer 6 of the present invention.

The essential elements of the conventional photocopy machine 2 include; the platen 4 on which an original document 10 to be reproduced is placed: a light source 12, a focusing lens 14, an electrostatically conductive belt surface 16; a corotron 18 for charging the belt surface 16; toner application means 22, delivery means 8 for delivering copy paper 20 to the belt surface 16; a discharge corotron 24 for releasing the image forming material (toner) from the belt surface 16 to the copy paper 20 and heat bonding means 26 for securing the toner to the copy paper 20.

As is now well known, the xerographic process proceeds by electrostatically charging the belt surface 16 by a corona discharge from the corotron 18, and then selectively discharging the belt surface 16 by reflecting the image from the original document 10 through the lens 14 to leave the belt surface 16 charged only in the pattern of the image of the printed material on the original document 10. Thereafter, the belt surface 16 picks up toner on the charged image pattern and transfers the toner to the copy paper 20. The toner is then securely adhered to the copy paper 20 by the heat bonding means 26 to provide a duplicate of the image appearing on the original document 10.

The serializer 6 is shown in FIG. 1 located essentially just in advance of the area at which toner is applied to the charged image pattern on the belt surface 16.

Figure 2:
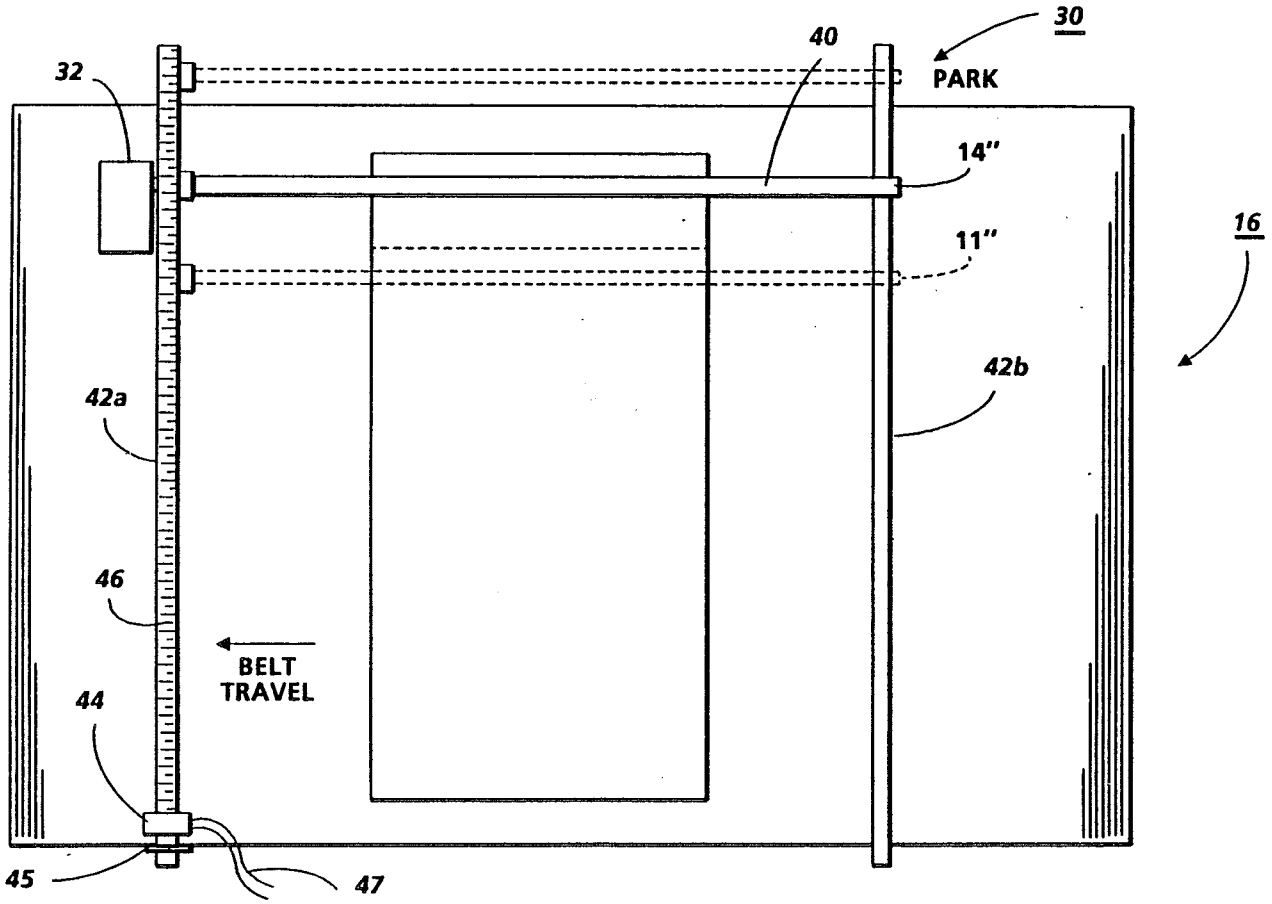
FIG. 2 is a plan view of a portion of one embodiment of the occluder bar and associated mechanism of the invention.
Figure 3:
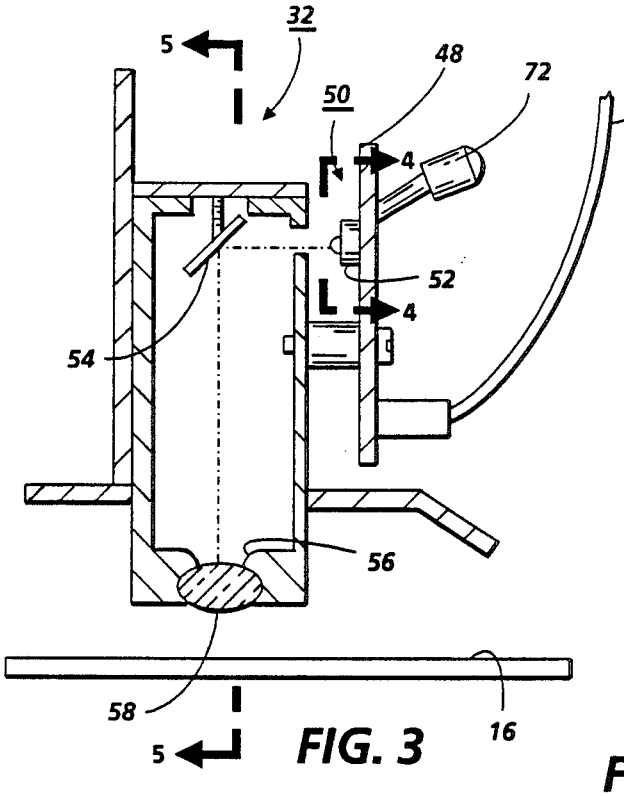
FIG. 3 is a sectional elevational view of the light projector head assembly.
Figure 4:
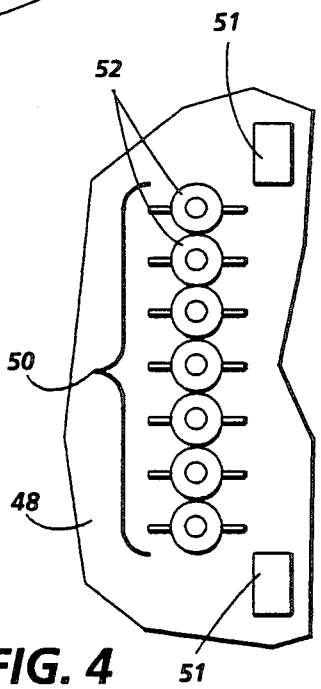
FIG. 4 is a sectional view through line 4—4 of FIG. 3 displaying of the LED array.
Figure 5:
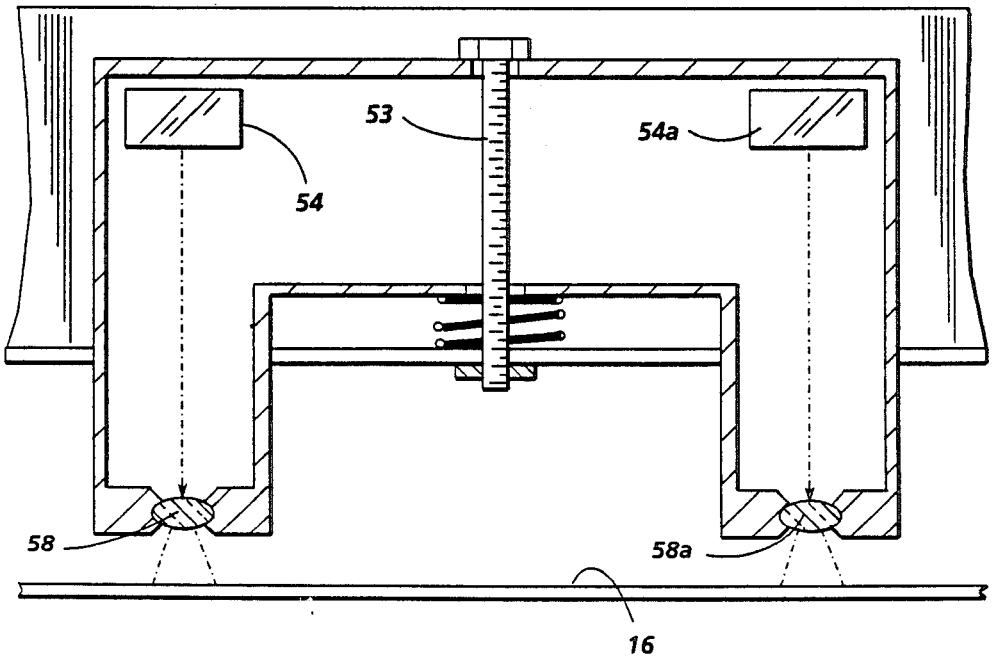
FIG. 5 is a sectional view through line 5—5 of FIG. 3.
Figure 6A:
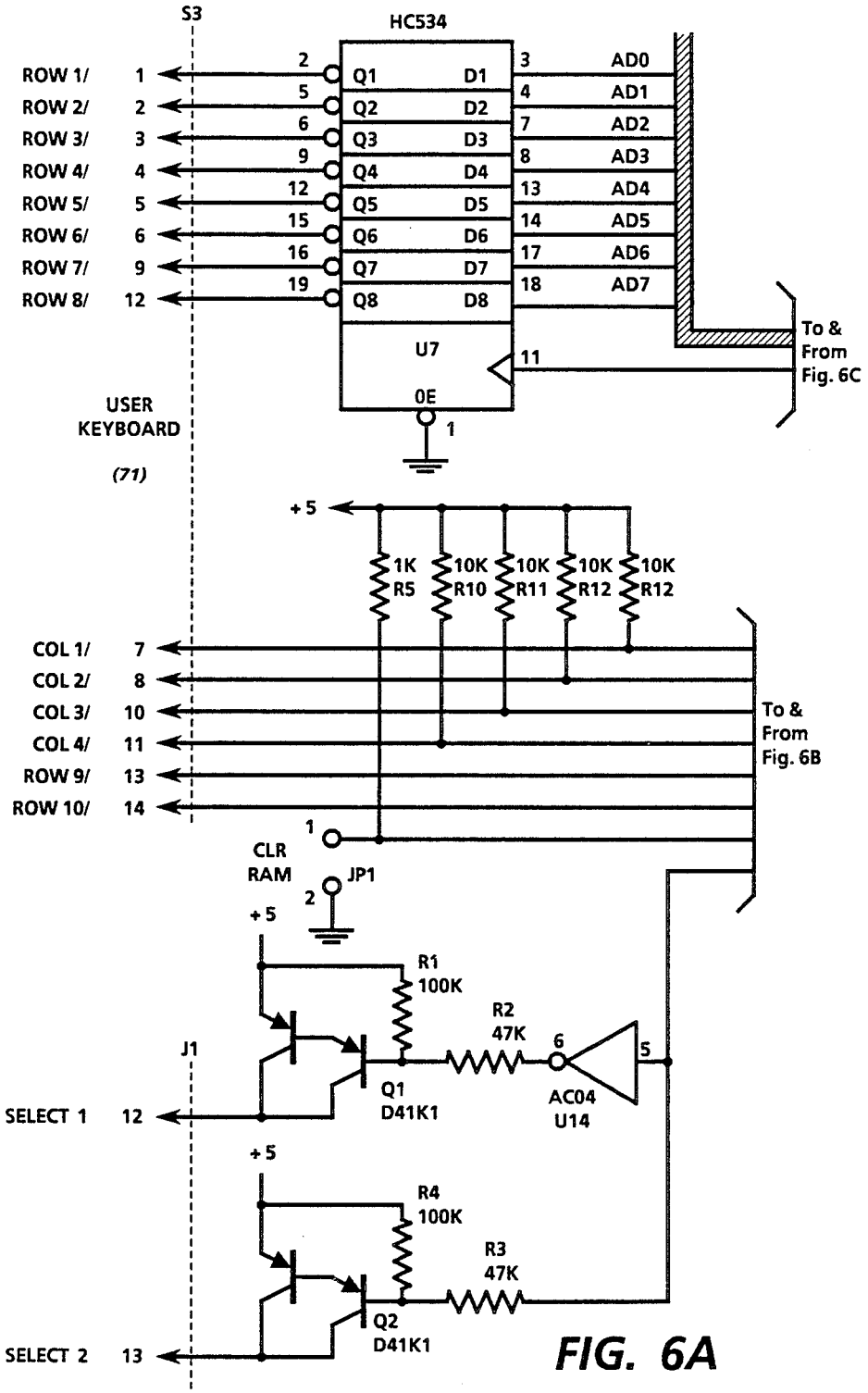
FIG. 6 is a detail drawing of the microprocessor circuitry relied on to direct the light emitting-LED aray.
Figure 6B:
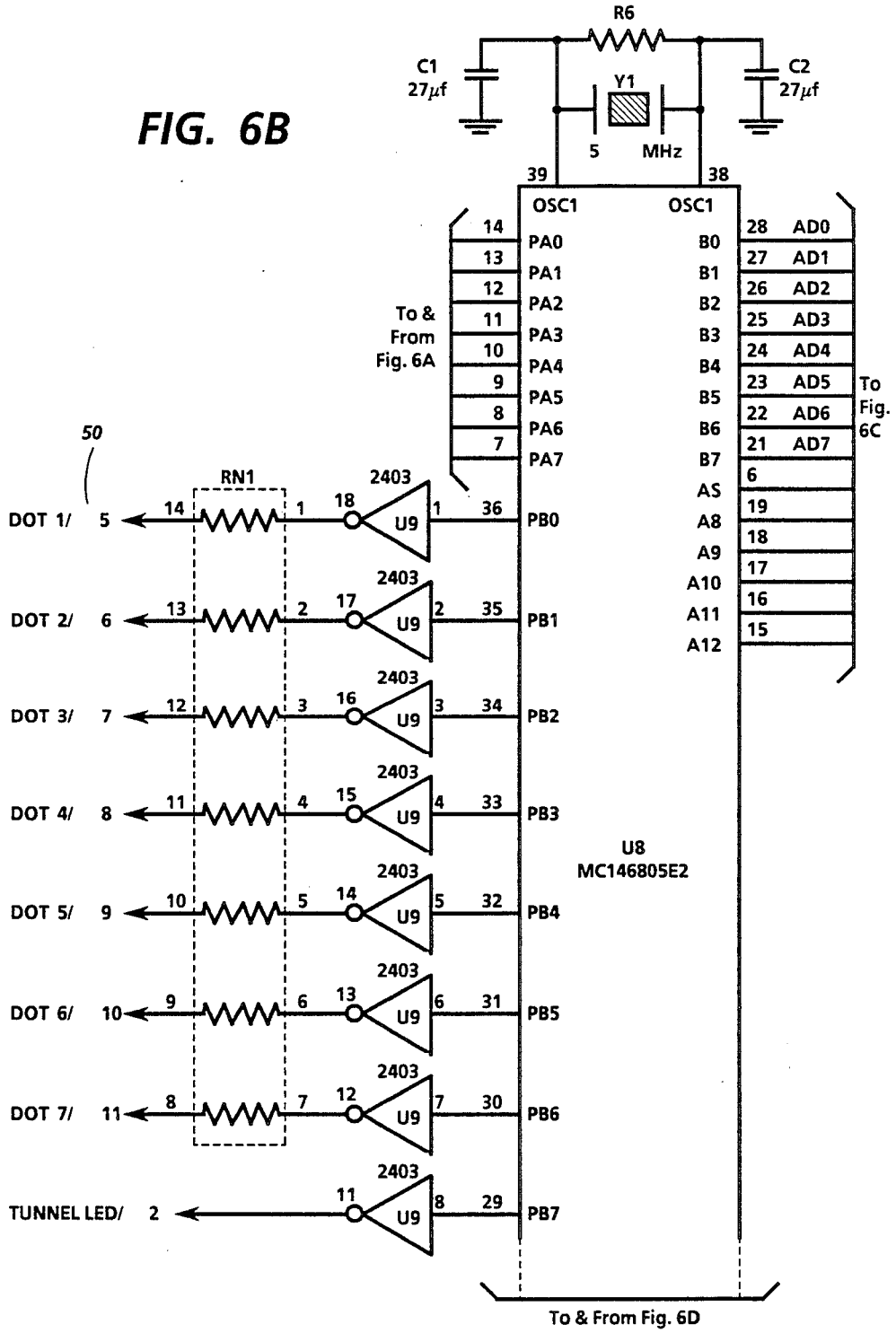
Figure 6C:
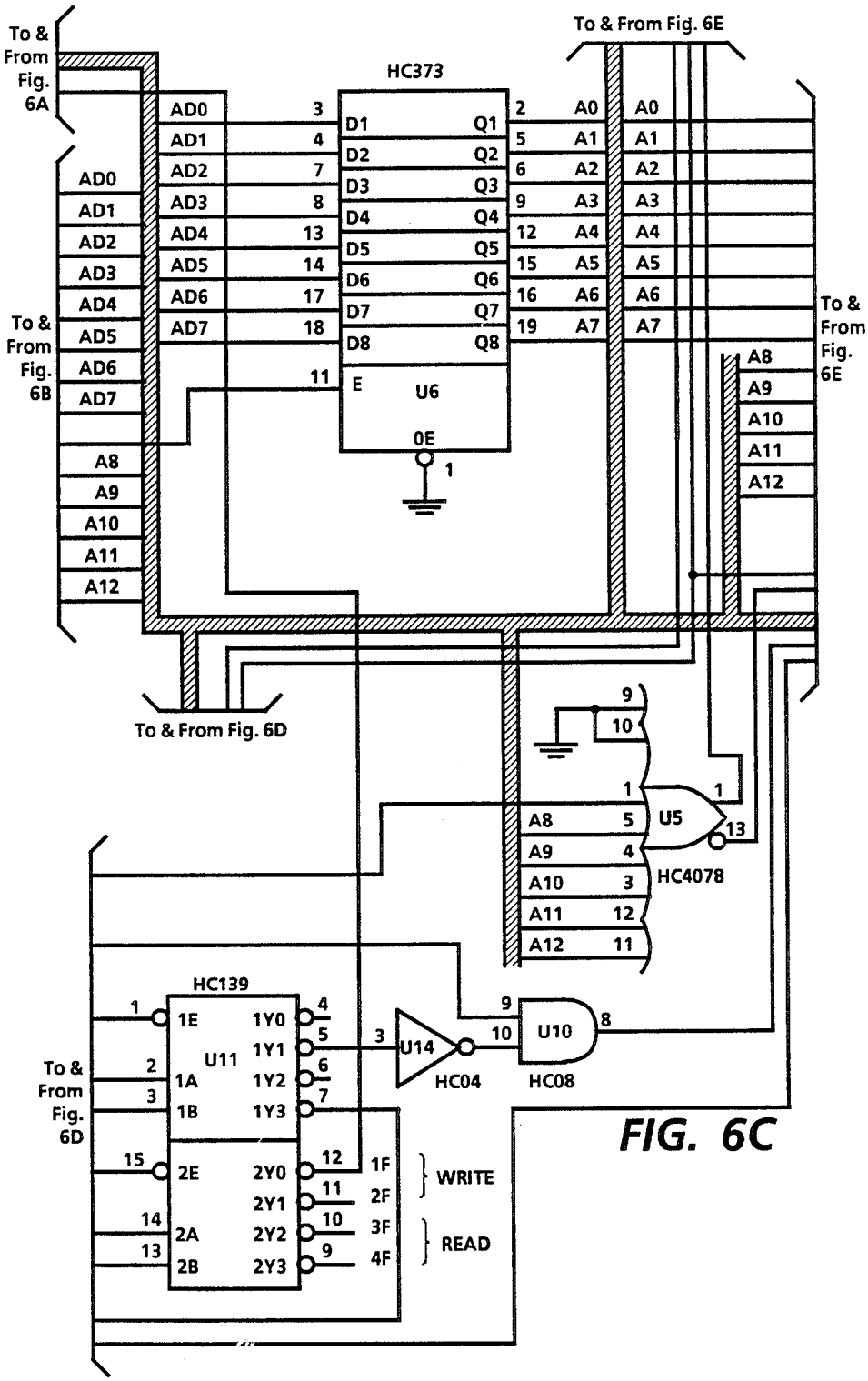
Figure 6D:
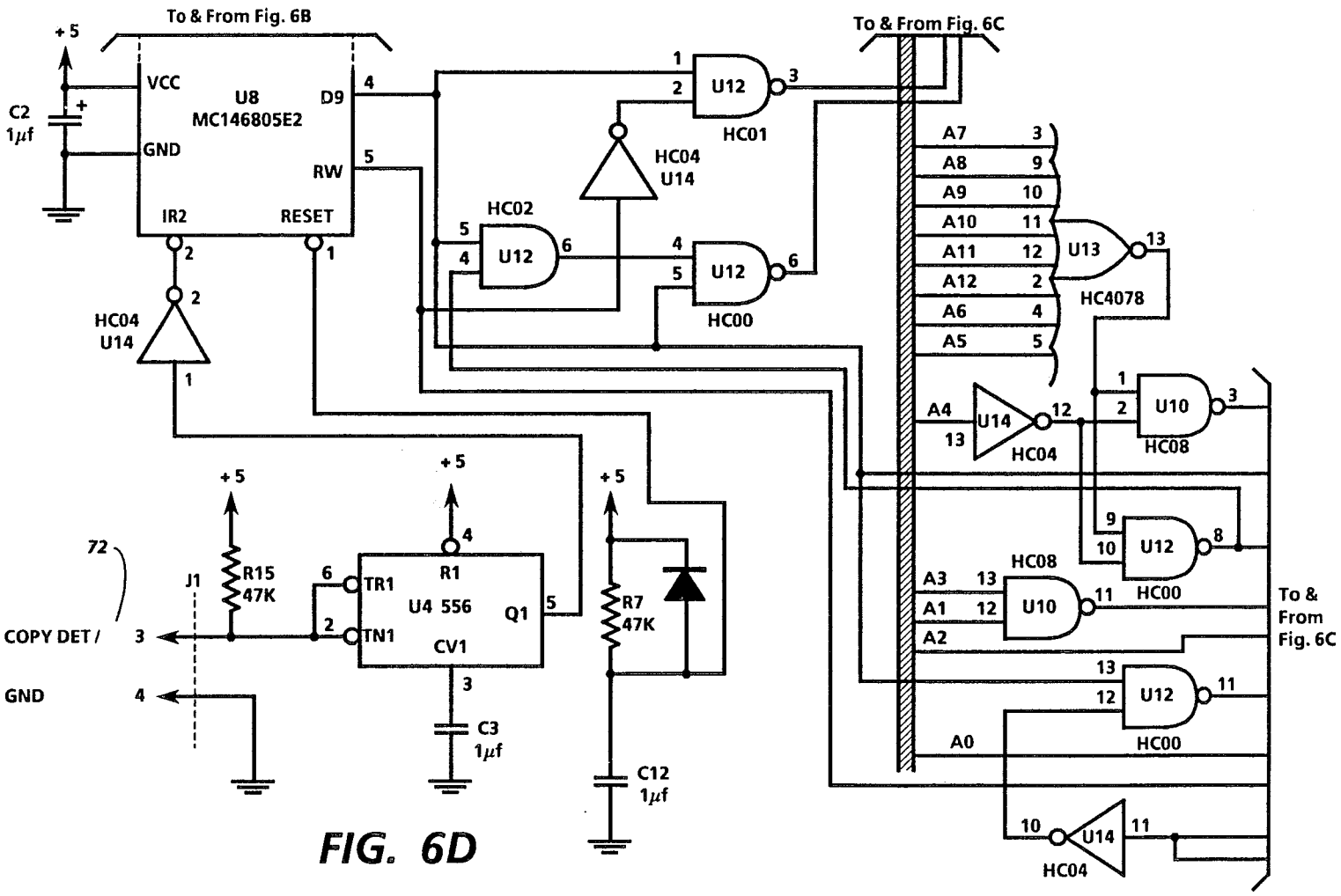
Figure 6E:
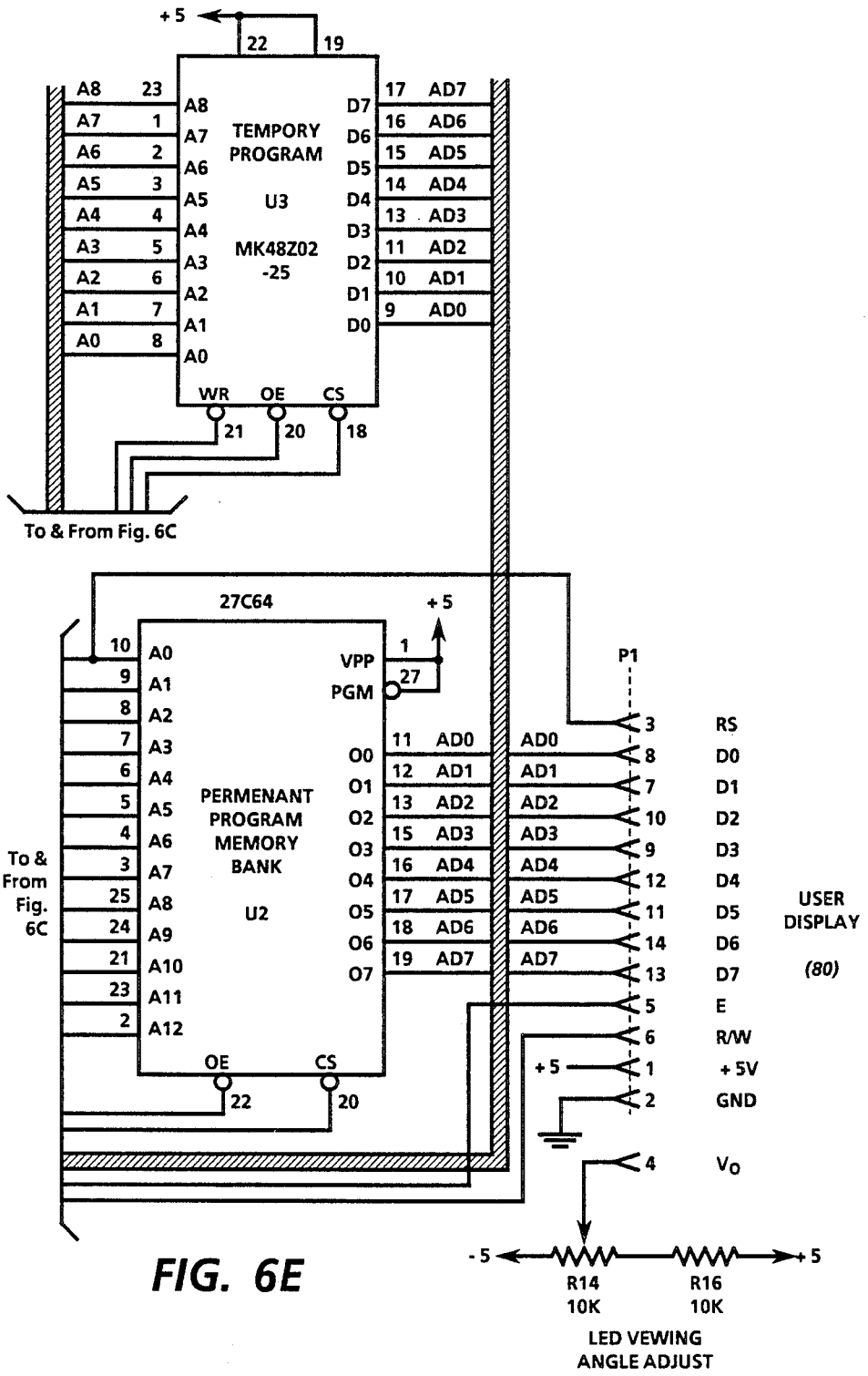
Figure 7:
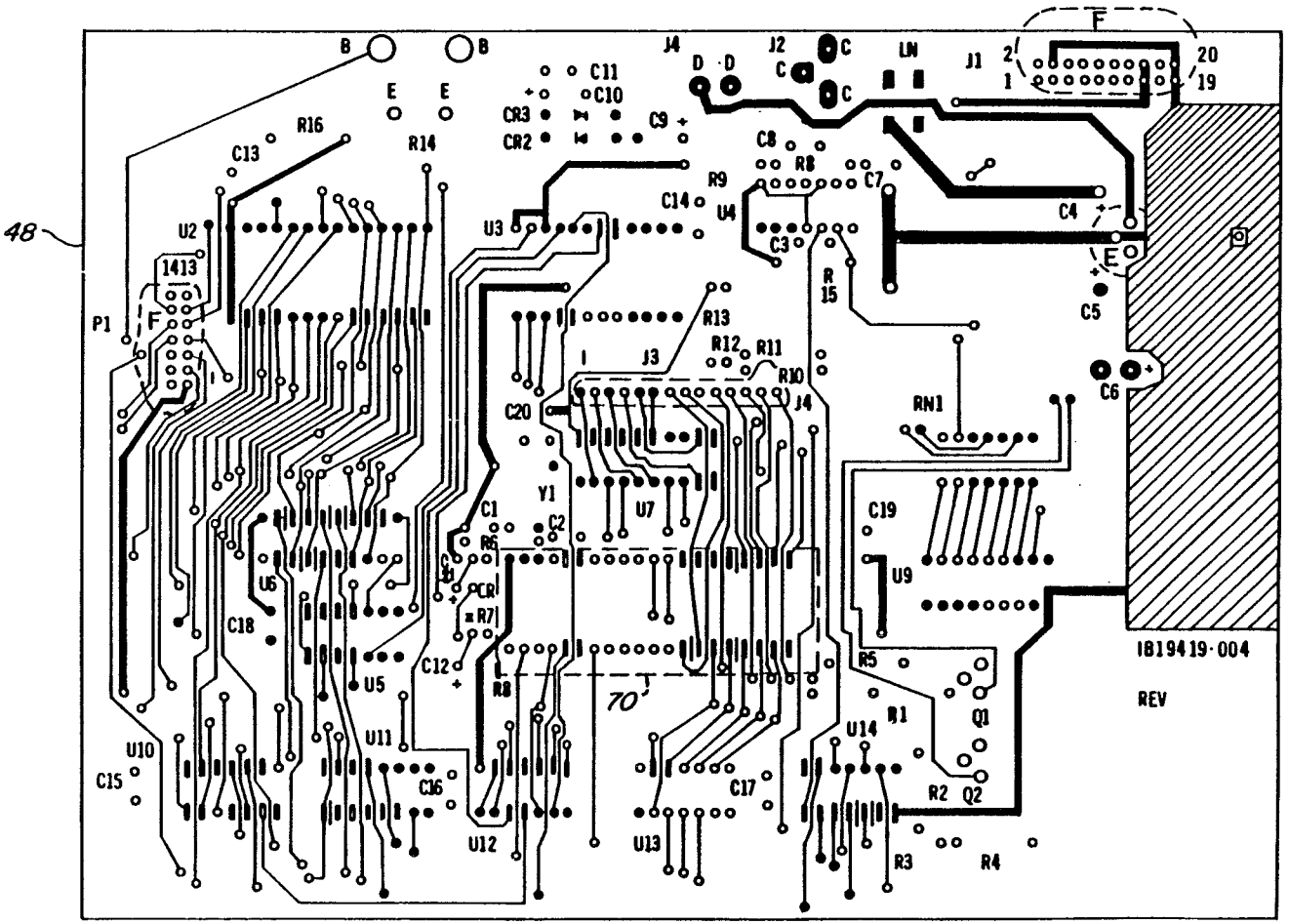
FIG. 7 is a plan view of one side of the printed circuit board on which the microprocessor is mounted.
Figure 10:
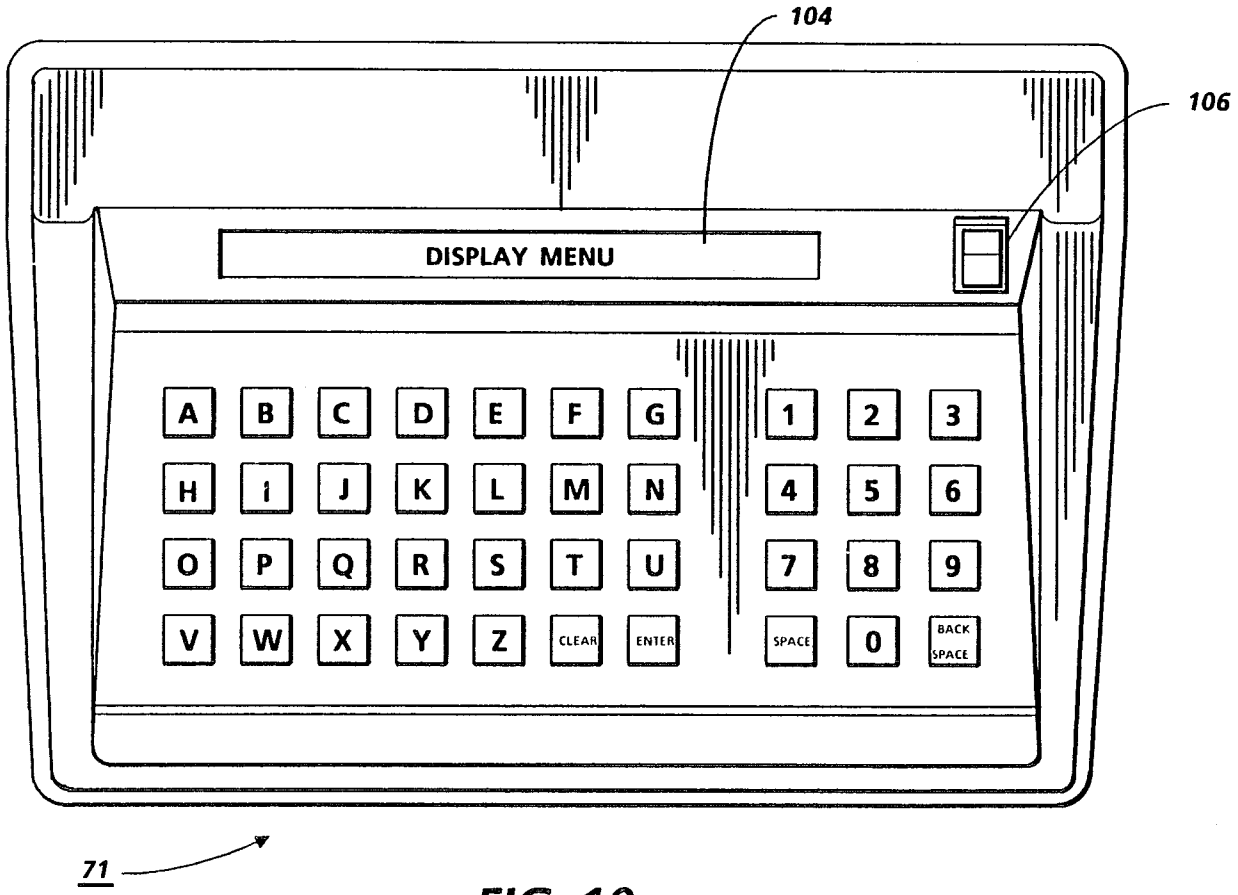
FIG. 10 is a plan view of the keyboard of the sequential system.

The serializer 6 includes an occluder bar assembly 30, best seen in FIG. 2, a light emmissive source means 32, best seen in detail in FIGS. 3, 4 and 5 and programmed control means 34, best seen in FIGS. 6, 7 and 10. Further, the serializer 6 is provided with an independent power source (not shown) such as a low voltage transformer; i.e., 12 v.A.C. which is mounted by plug-in construction to a 110 v.60 Hz power outlet.

As seen in FIG. 2, the occluder bar assembly 30 is comprised of an occluder bar 40, rails 42*a* and 42*b* on which the occluder bar 40 is mounted and a D.C. motor 44 for advancing the occluder 40 to various positions with respect to belt surface 16. The positions include PARK, which is to the side of the belt surface 16, and two locations above the surface appropriate for use with 11 inch copy paper and 14 inch copy paper. The D.C. motor is connected to the rail 42*a* by means comprised of a wheel 45 mounted on the D.C. motor shaft and screw threads 46 formed on the rail 42, and is provided with conductors 47 to enable energization of the D.C. motor in response to a signal from a button 106 (FIG. 10) on the control keyboard 71. Alternatively, keys I or S might also be used to start the motor operation. The occluder bar 40 is transparent and will pass less than 100% of the light emanating from a strobe bulb. It has been discovered that a material identified as POLYCAST GREEN 2092 serves well as the occluder bar 40 of the present invention.

The light emmissive source means 32, as seen in FIGS. 3–5, is comprised of an array or matrix 50 of light emmitting diodes 52 (LEDs), a mirror 54, a light passing opening 56 in the source means 32 and a lens 58 mounted in the opening 56. As seen in FIG. 4, the LED array 50 is illustrated as seven aligned LEDs 52 mounted on a printed circuit board 48, each of which is programmed to produce selective illumination by discrete pulsations. The pulsations discharge dot areas 60 (see FIGS. 8 and 9) on the charged belt surface 16. For example, a line of LEDs may be pulsed simultaneously to produce a line of dots 60 in the charged layer of belt surface 16. Then as the belt surface 16 advances, the LEDS 52 are illuminated in another pattern to discharge aligned dots 62. After five adjacent selective illuminations of the LED array 50, a numerical, alphabetic or alphanumeric character 64 will be defined on the belt surface 16. It has been found that the matrix should be arranged with 0.10 inch between each LED 52 and an intensity capacity for each LED of about 40 to 60 lumens when used in a conventional xerographic application wherein the belt surface 16 is charged to about 600 volts D.C. Conventional HLMP 6758 LEDS with a lens diameter of 0.07 inches are particularly well suited for use in the serializer 6. Margin LEDS 51 are provided to erase the black occluded area above and below the character area when desired.

In one of the present preferred embodiments, the light emitting source means 32 may be constructed to include two identical sections aligned with the occluder bar 40 positions for the eleven inch and fourteen inch documents respectively. As seen in FIG. 5, the identical parts are like numbered; i.e., the mirrors are numbered 54 and 54*a*. Image focusing adjustment means comprising a screw 53 and spring 55 are also provided. The board 48 mounts the LEDs 52 and photocell 72. The photo cell 72 is positioned to be exposed to the machine light source 12 and actuates the serializer 6 upon exposure to the copy producing illumination from the machine light source 12.

Figure 2A:
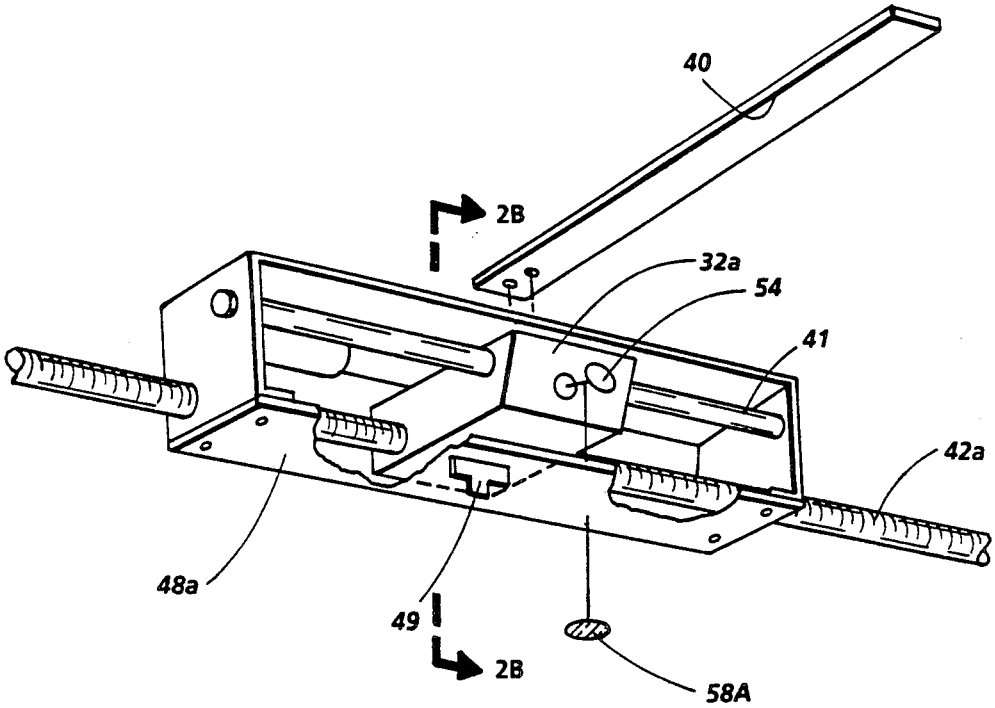
FIG. 2A is a perspective view of another embodiment of the occluder bar and light source printer of the invention.
Figure 2B:
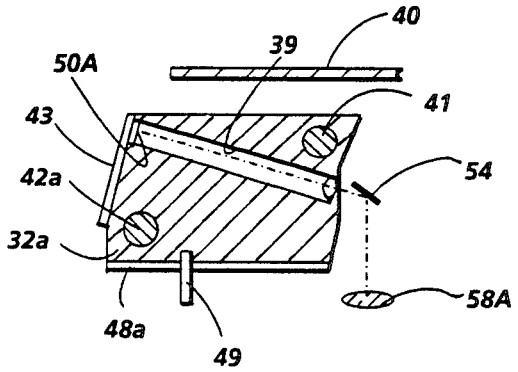
FIG. 2B is a sectional elevational view taken through line 2B—2B of FIG. 2A.

FIGS. 2A and 2B depict another embodiment of a single light source means 32A mounted on rail 42*a* to travel with the occluder bar 40 to the various appropriate locations. The bar 40 is mounted on the top and printed circuit board 48A is mounted on the bottom of the light source means 32A, with the latter electrically connected to the LED array 50A through conductive mount 43. The light source means 32A is mounted on the screw threaded mount 42*a* and a support bar 41 for travel with the occluder bar 40. A sensor tab 49 is arranged to protrude through the printed circuit board to detect the proper location of the assembly. As best seen in FIG. 2B, the LED array 50A extends into the entry of a passage 39 that terminates in a lens 58A and a mirror 54A which direct light from the LED array 50A to the belt surface 16.

Printed circuit board 100, seen in FIG. 7 mounts a microprocessor 70 and is located within the control means 34 (FIG. 7). Electronic communication is provided between the board 100 and the LEDs 52 and photocell 72 by conductors 102 (FIG. 3). The microprocessor 70 provides the electronics through which programmed pulsing instructions are conveyed to the LEDs 52.

One side of the printed circuit board 100 is shown in FIG. 7 with the microprocessor 70. The microprocessor 70 executes a program 80, shown illustratively in the flow charts in FIGS. 13A–G. In practice, a microprocessor 6805 E2 can be well adapted to the present invention. The essential elements of the microcomputer relied on for the serializer 6 application are seen in FIG. 6 and comprise the permanent program storage U2; the temporary memory storage U3; address decoding U5, U10, U11, U12, U13, U14; address demultiplexing U6; photocell shaping interface circuit U4, U14; keyboard scanner U7 and a part of U8; and the LED control U9, part of U8, RN1 and $Q_1$–$Q_2$.

Figure 13A:
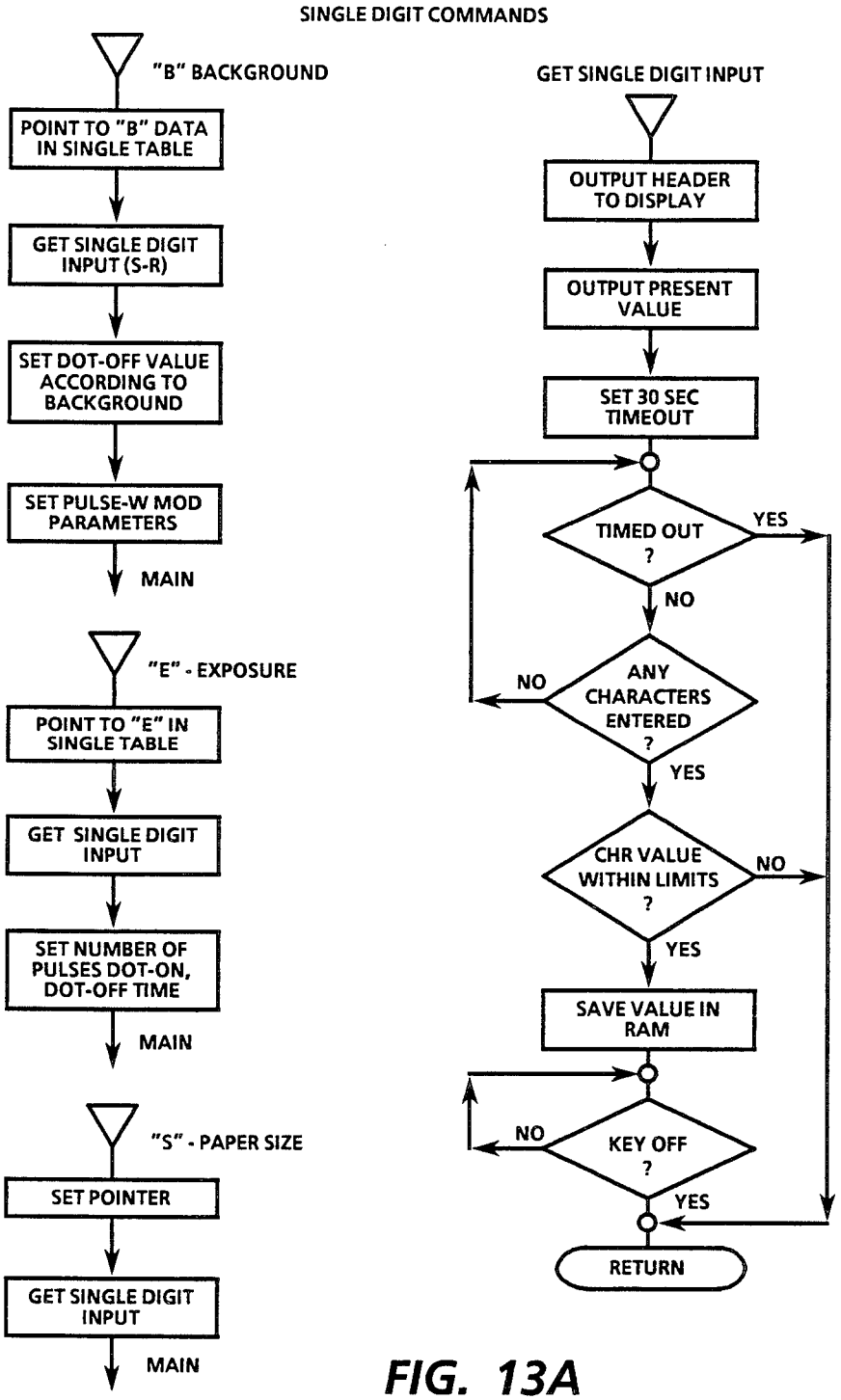
FIGS. 13A–13G are flow charts for a program arranged to control the sequential printing and overall operation of the machine.
Figure 13B:
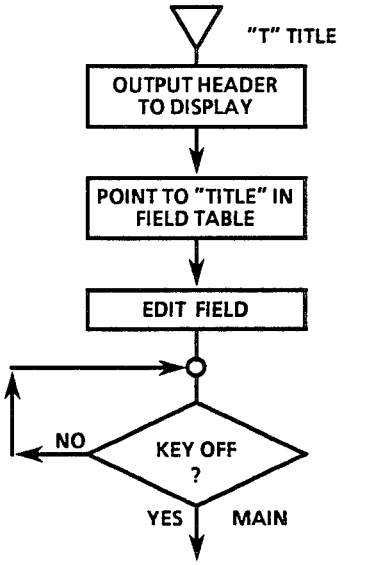
Figure 13B:
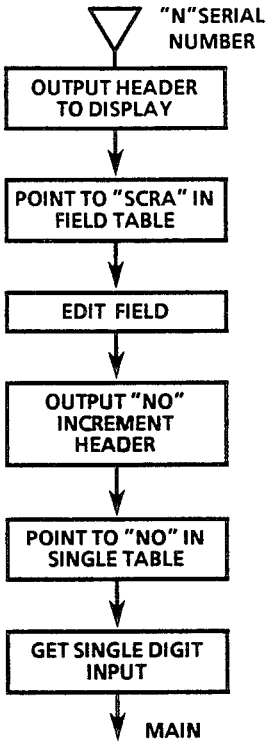
Figure 13B:
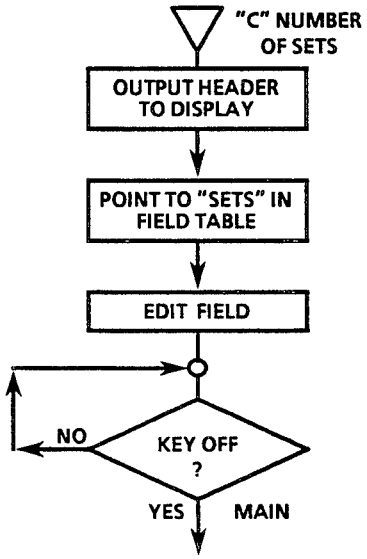
Figure 13C:
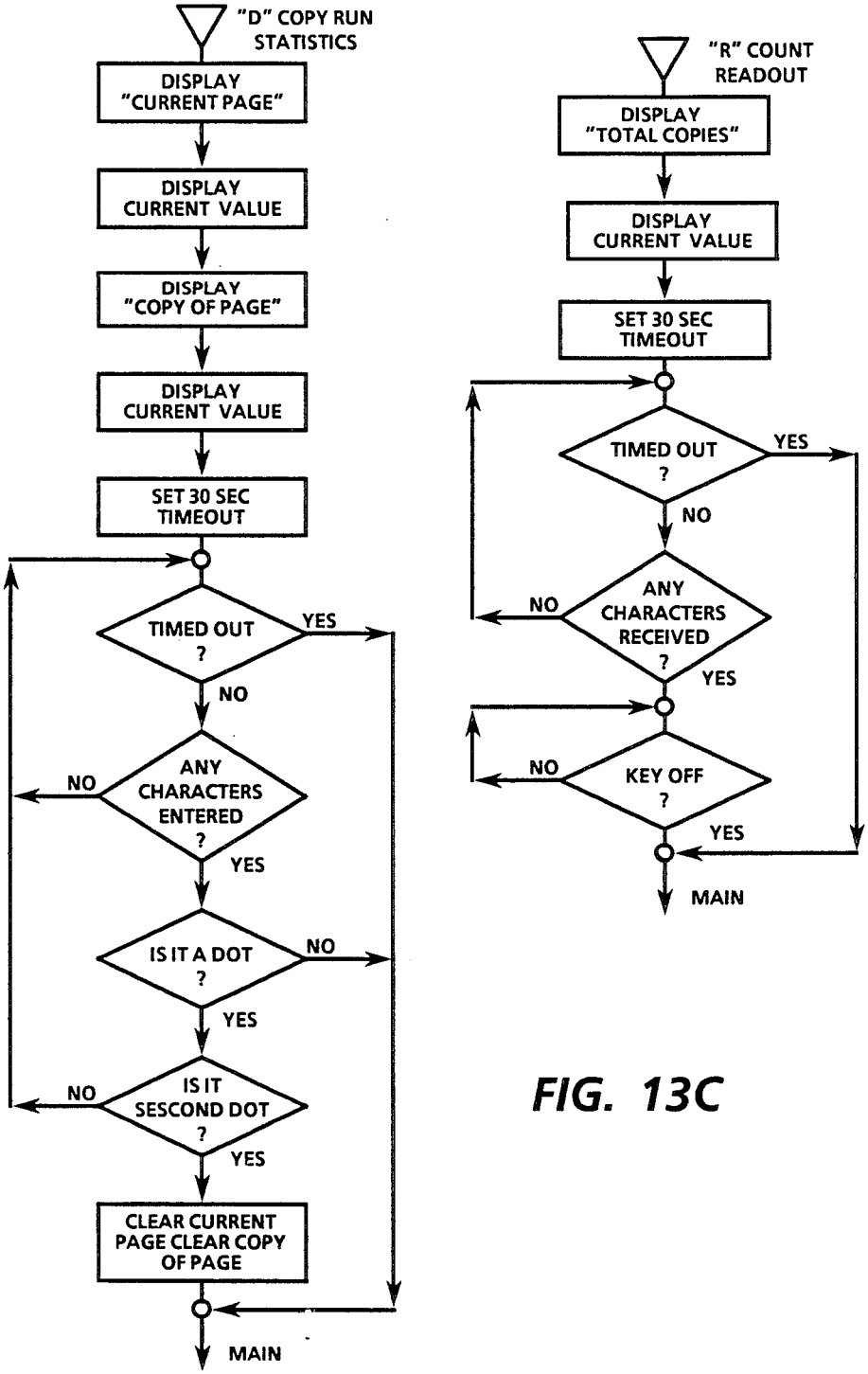
Figures 1, 13D:
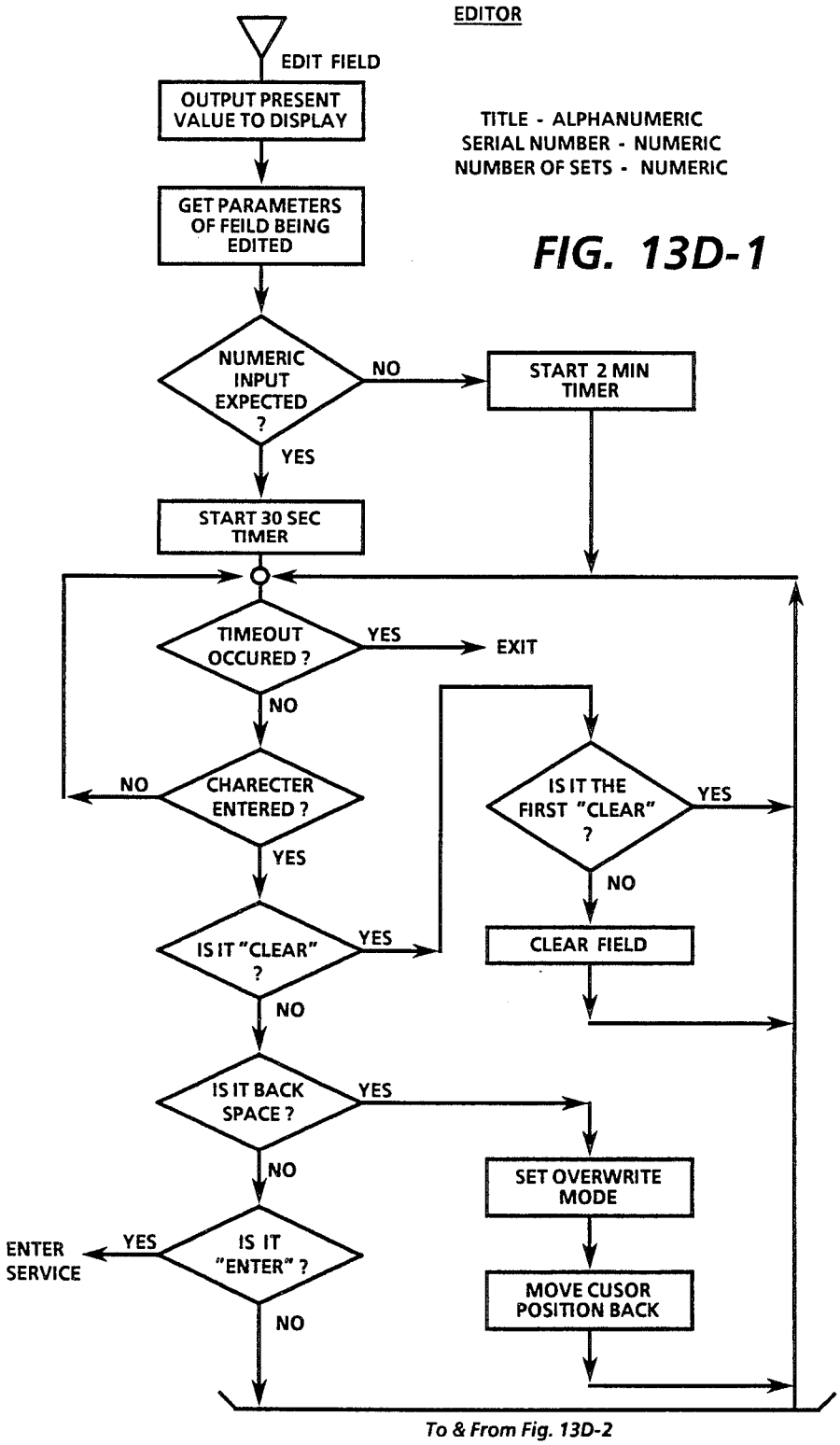
Figures 2, 13D:
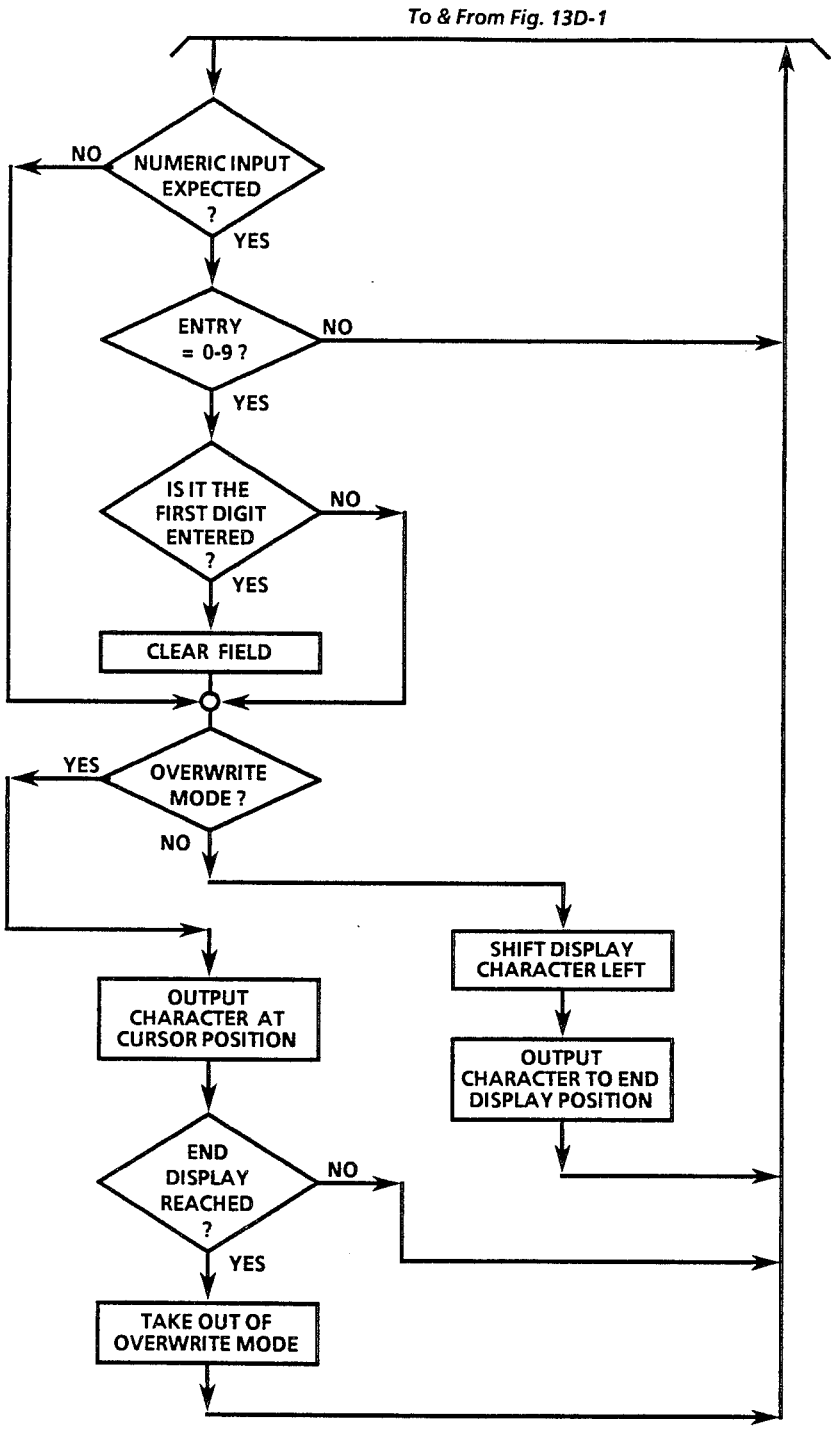
Figure 13E:
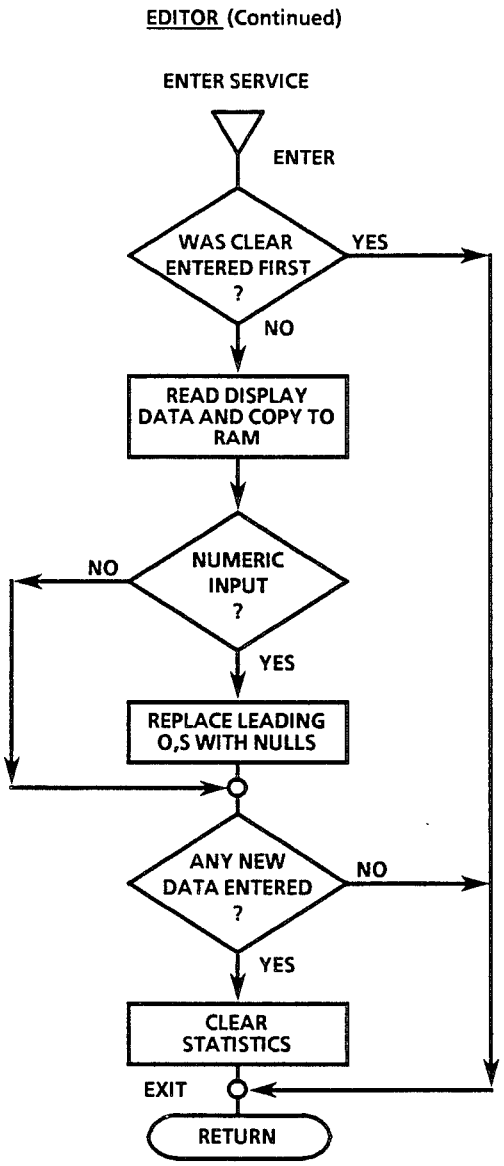
Figures 1, 13F:
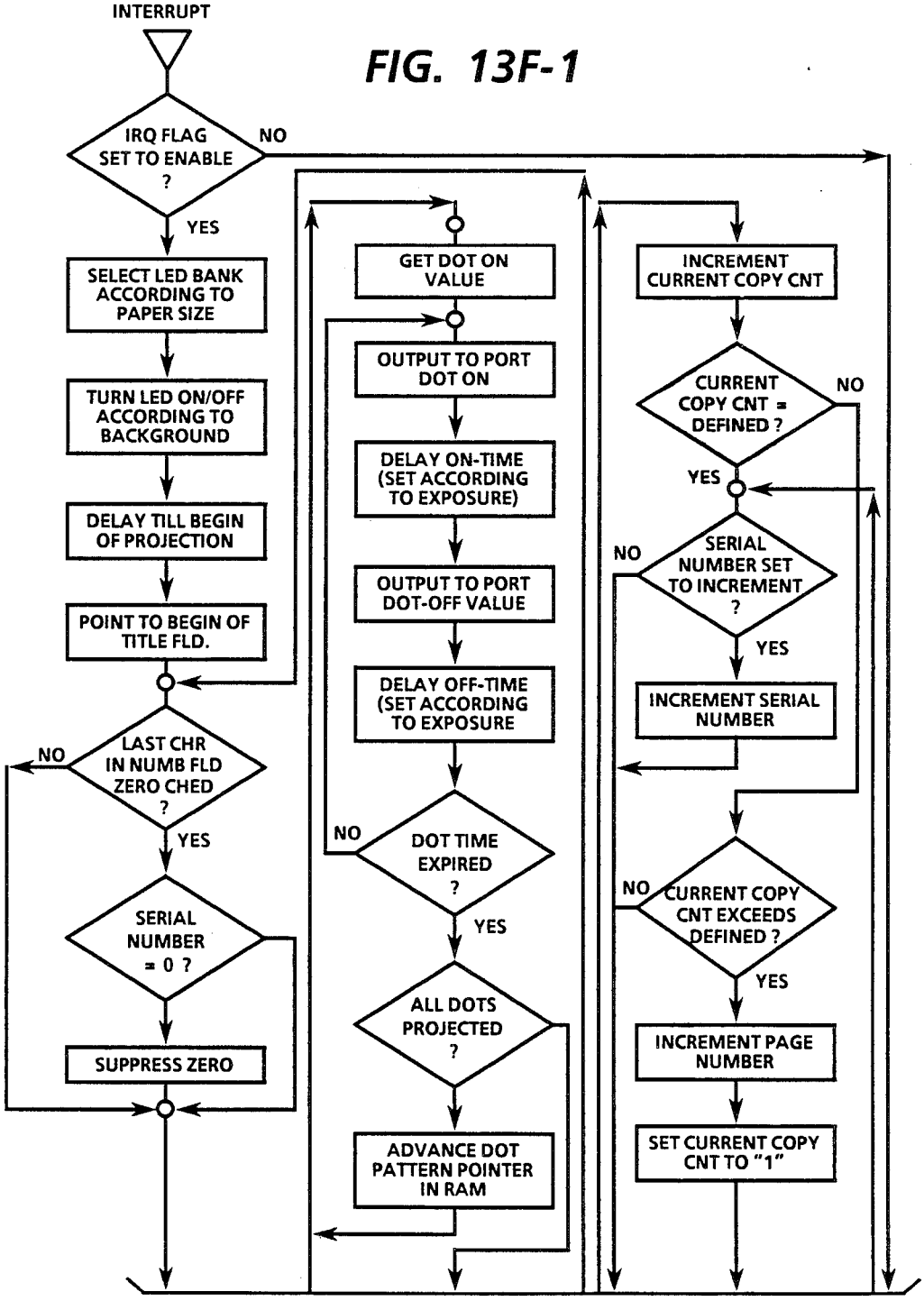
Figures 2, 13F:
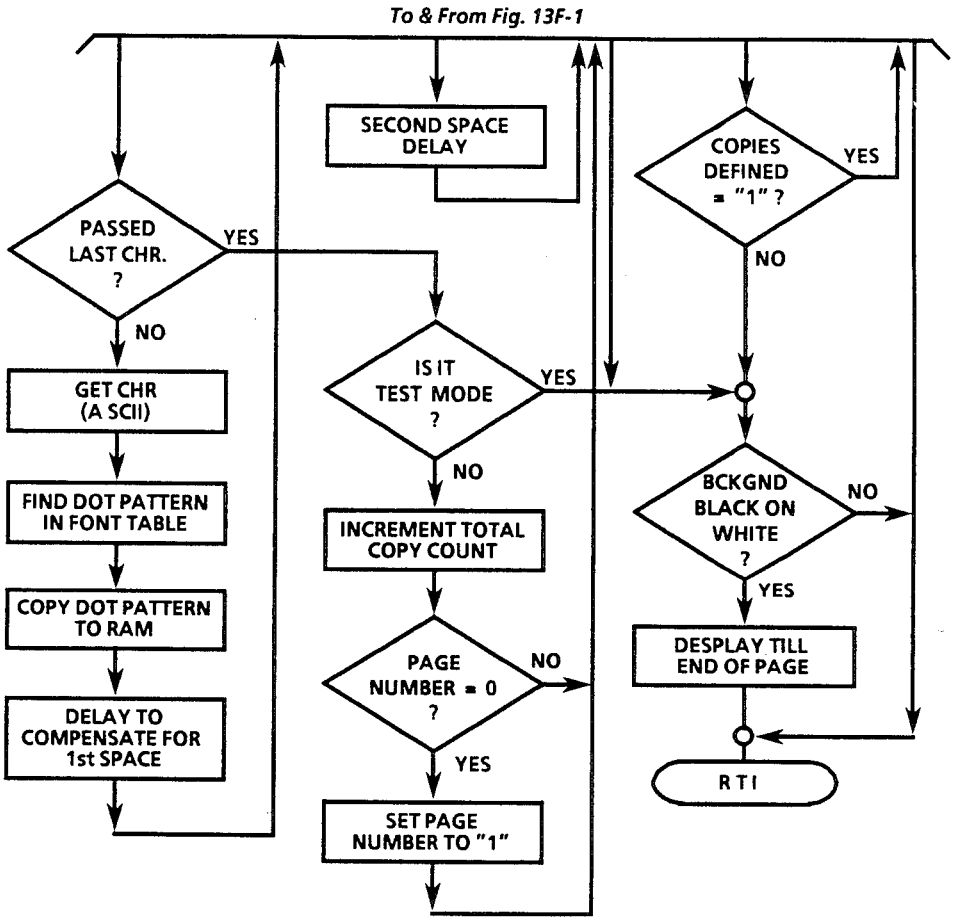
Figures 1, 13G:
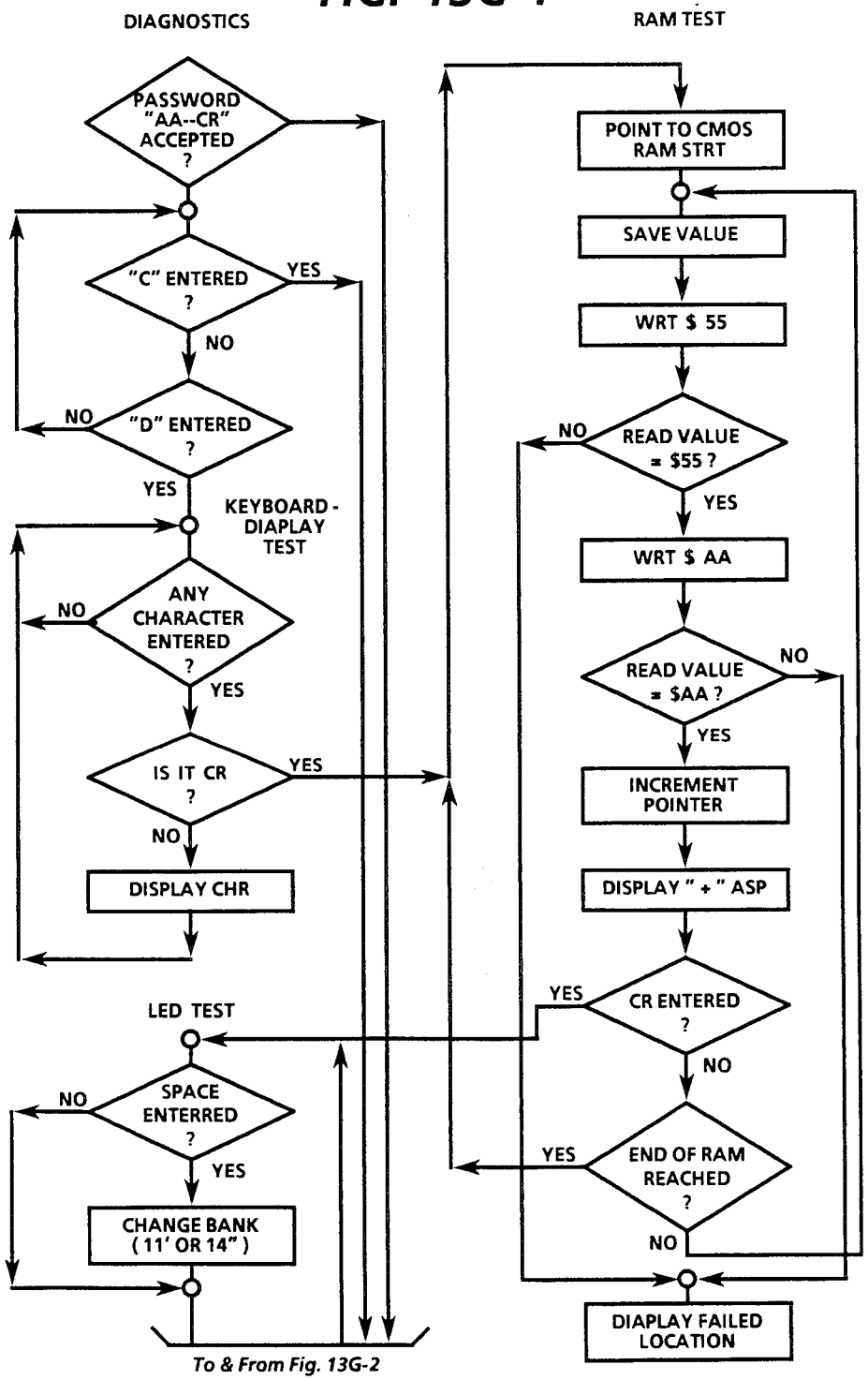
Figures 2, 13G:
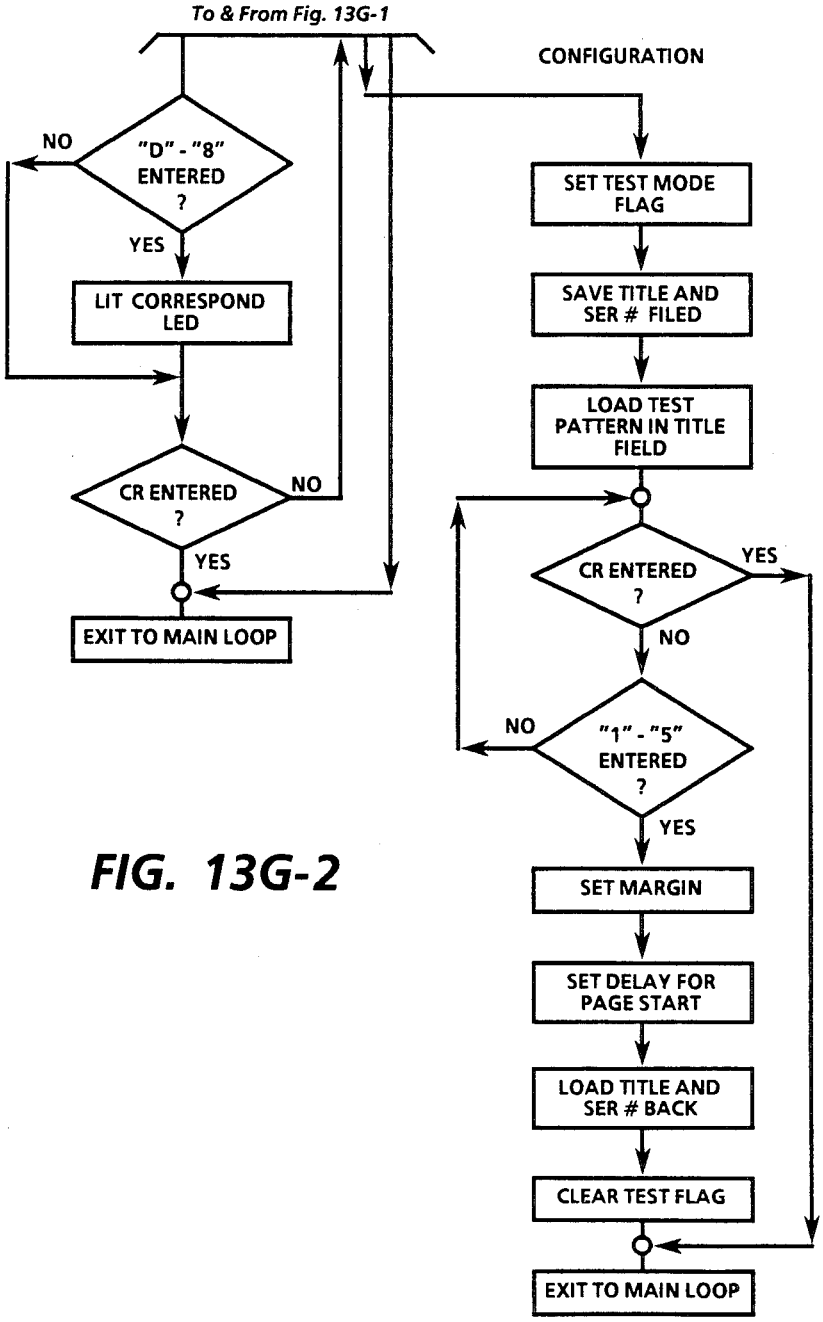

Normally after initialization the program 80 is set in an idle loop. Upon illumination sensed by the photocell 72, which is shaped by U14 and U4, an interrupt occurs to the microprocessor 70. The program delays until character printing is commanded, at which time sequential printing occurs as commanded by a program such as shown in FIG. 13F, which program is stored in Permanent Program Memory Bank U2. Upon completion of the printing sequence the microprocessor under program control returns to the idle loop.

The keyboard 71 shown in FIG. 10 is arrranged with a menu display 104 through which program instructions are provided to the user to enable the user to enter parameters (paper size, exposure) or data such as the title field.

With the belt surface 16 travelling at the rate of 12 in./sec., the LEDs are programmed to pulse and form one character in 11.2 milliseconds. When printing white on black (discharging the character area), the 11.2 milliseconds consist of seven discrete and equal intervals; the first and last of which do not generate the character but provide the space between each of the characters which as a composite constitute the serial image. Thus, each of the seven intervals must equal 1.6 milliseconds or 1600 microseconds. When printing black on white (discharging the area surrounding the characters), the seven intervals are comprised of a first and last interval of 960 microseconds and five 1856 microsecond printing intervals.

The mechanism in the preferred embodiment is provided with means to select four different intensities depending on the lightness or darkness of the original document background. Button E (FIGS. 10 and 13*a*) is provided to deliver a menu display to the user to enable selection of one of the four intensity patterns prior to engaging the serializer 6.

Figure 12:
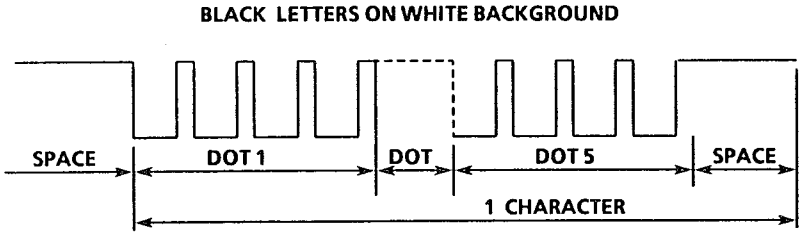
FIGS. 12A and 12B are graphs of the pulsating sequence illustrating the intensity pattern to discharge the area surrounding the characters to provide black on white sequential printing.
Figure 12A:
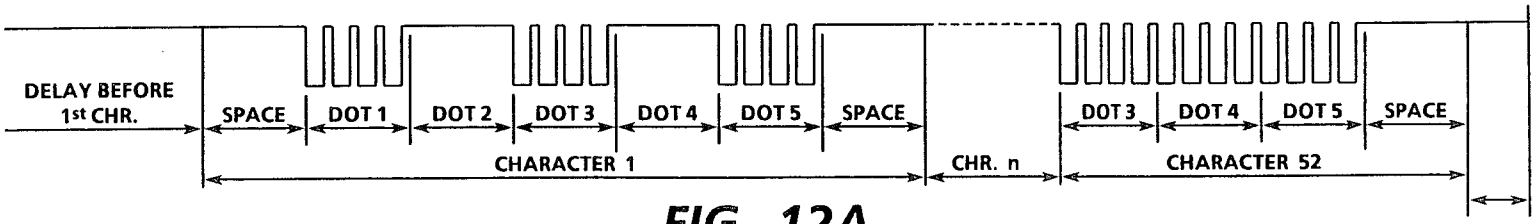

It has been discovered that character generation in the black on white is best achieved under normal conditions when the following pulsation pattern shown in FIGS. 12 and 12*a* is dictated:

| Exposure | Off Time μ Sec. (per dot) | On Time μ Sec. (per dot) | On Time % percent |
|---|---|---|---|
| 2 | 1648 | 208 | 12 |
| period length: | 464 microseconds (time off & time on) | | |
| loop length: | 8 microseconds | | |

| Exposure | Number of periods per dot | Off Loop count per period | On Loop count per period | Time Off per period μs | Time On per period μs |
|---|---|---|---|---|---|
| 2 | 4 | 49 | 4 | 412 | 52 |
| 1st space delay count: (plus calculation time) | | 61 (610 μs) | | | |
| 2nd space delay count: | | 96 (960 μs) | | | |

Figure 11:
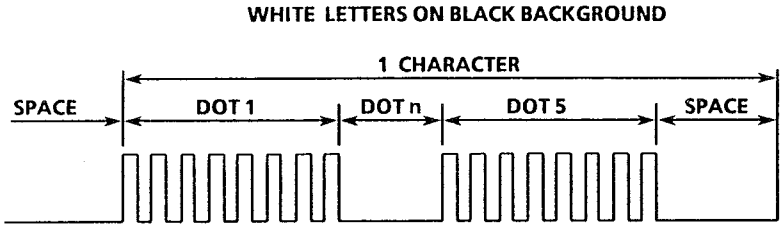
FIGS. 11A and 11B are graphs of the pulsating sequence illustrating the intensity pattern to produce white letters on the black background.
Figure 11A:
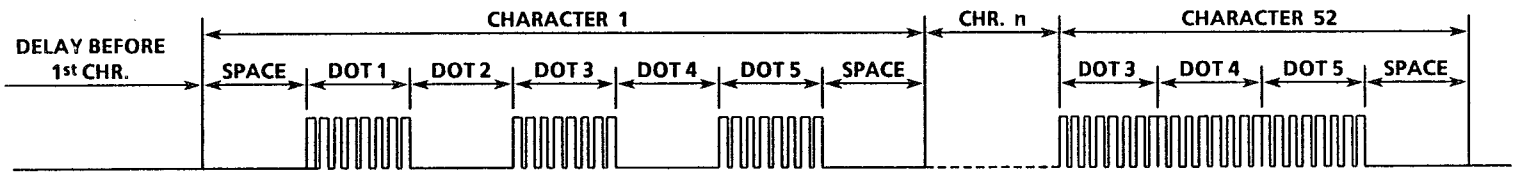

The preferred character generation for white characters on a black background mode illustrated generally in FIGS. 11 and 11*a* under normal conditions is achieved with the following pulsation pattern:

| Exposure | Off Time μS (per dot) | On Time μS (per dot) | On Time % percent |
|---|---|---|---|
| 2 | 608 | 992 | 62 |
| period length: | 200 microseconds | | |
| loop length: | 8 microseconds | | |

| Exposure | Number of periods per dot | On Loop count per period | Off Loop count per period | Time on per period μs | Time Off per period μs |
|---|---|---|---|---|---|
| 2 | 8 | 13 | 7 | 124 | 76 |
| 1st space delay count: (plus calculation time) | | 125 (1250 μs) | | | |
| 2nd space delay count: | | 160 (1600 μs) | | | |

Figure 8:
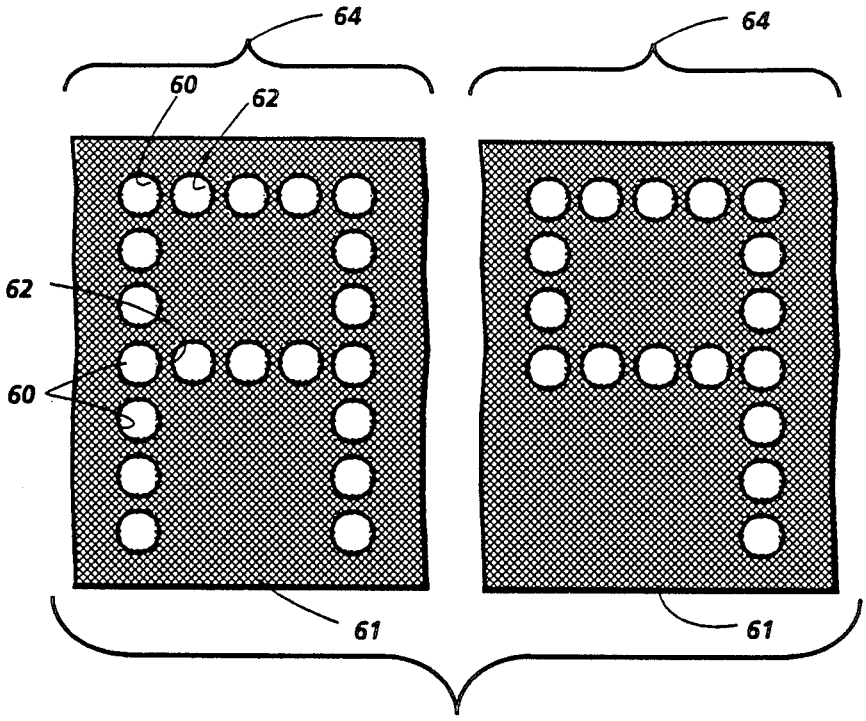
FIG. 8 illustrated a character of the sequential marking system formed in white on black.
Figure 9:
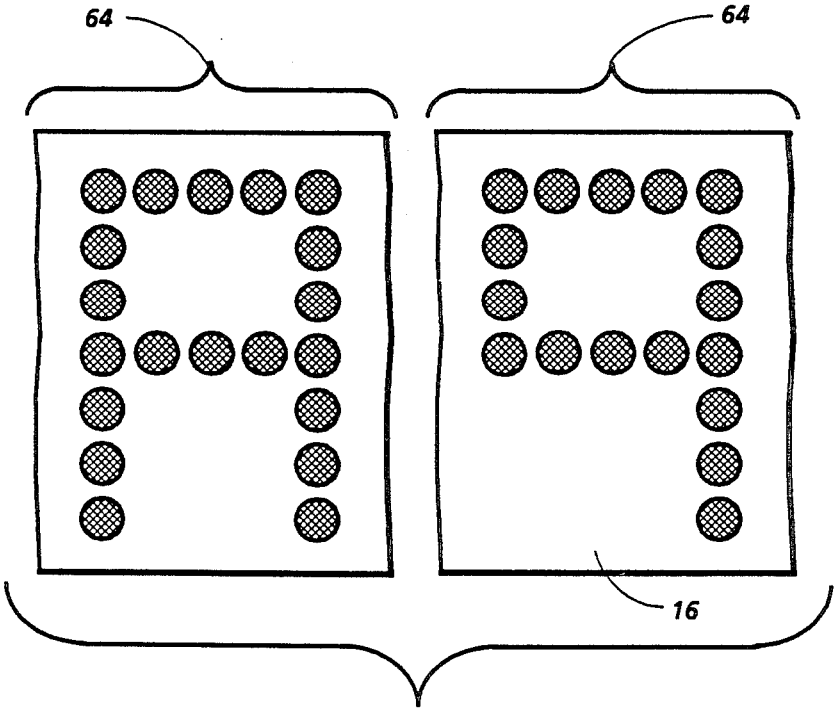
FIG. 9 illustrates a character of the sequential marking system formed in black on white.

As seen in FIG. 8, two characters 64 are shown in white lettering on a black background. The characters 64 were produced by discharging the belt surface 16 in a dot pattern. Dots 60 were produced by all seven LEDs 52 (FIGS. 3 and 4) being simultaneously illuminated and their outputs focused through lens 58 onto the belt surface 16. The dots 62 were produced by illuminating only LEDs 1 and 4 of the LED array 50 as the dot 62 location on the belt surface 16 passed under the lens 58.

As a result fifty two characters can be printed on eight and one-half inch width copy paper 20.

In operation, the serilaizer 6 is actuated by a start button (power switch 106) on the keyboard 71. The occluder bar 40 is automatically advanced to the position at which it will shield a length or stripe 61 along the belt 16 corresponding to an area across the bottom of the copy paper when the discharge light 12 of the machine reflects the image producing light pattern from the original document 10 onto the belt surface 16. The stripe 61 is in registry with the LED matrix and as the belt surface 16 passes under the LED matrix 50 a number, letter or alphanumeric character is produced in the charge thereon by the selective discharge of the belt in the stripe area 61. If white on black is desired the LED matrix is illuminated in the image of the character and only the character pattern area is discharged. Thus, toner will be picked-up in the entire surrounding stripe area 61. (See FIG. 8). Conversely, if black on white is desired the entire stripe 61 will be illuminated by the LED matrix except for the character pattern area. Thus, toner will only be picked-up by the character area. (See FIG. 9). In the black on white printing mode, the margin LEDs 51 will be illuminated continuously to erase the stripe area extending beyond the characters 64.

A series of flow charts detailing algorithms making up a suitable program for implementing the system and method of the present invention is shown in FIGS. 13A–13G; with FIG. 13F detailing the sequencing operation.

We claim:

1. An electrophotographic printing machine for reproducing an original document with a copy thereof having additional indicia thereon, including:

a photoconductive member;

means for charging at least a portion of said photoconductive member to a substantially uniform potential;

means for illuminating selectively the charged portion of said photoconductive to discharge selectively the charged portion of said photoconductive member to record an electrostatic latent image on said photoconductive member corresponding substantially to the original document being reproduced;

means for masking a region of the charged portion of said photoconductive member discharged normally by said illuminating means to prevent the discharge thereof by said illuminating means; and means for discharging selectively the masked region of the charged portion of said photoconductive member to record an electrostatic latent image thereon corresponding to the additional indicia.

2. A printing machine according to claim 1, wherein said masking means includes:

a movable occluder bar; and means for moving said occluder bar to a specified position so as to be interposed between said illuminating means and the region of the charged portion of said photoconductive member to prevent the discharge thereof.

3. A printing machine according to claim 2, wherein said discharging means includes a plurality of light emitting diodes to illuminate the region of the charged portion of said photoconductive member masked by said occluder bar to record an electrostatic latent image thereon corresponding to the additional indicia.

4. A printing machine according to claim 3, wherein said discharging means includes:

a lens aligned with the region of the charged portion of said photoconductive member; and a mirror arranged to direct the light from said light emitting diodes through the lens.

5. A printing machine according to claim 4, wherein said discharging means includes operator controllable means for energizing selected ones of said plurality of light emitting diodes to record an electrostatic latent image on said photoconductive member having characters as the additional indicia.

* * * * *